US011530472B2

(12) United States Patent
Chintalapati et al.

(10) Patent No.: US 11,530,472 B2
(45) Date of Patent: Dec. 20, 2022

(54) STAINLESS STEEL ALLOYS, TURBOCHARGER COMPONENTS FORMED FROM THE STAINLESS STEEL ALLOYS, AND METHODS FOR MANUFACTURING THE SAME

(71) Applicant: Garrett Transportation I Inc., Torrance, CA (US)

(72) Inventors: Pavan Chintalapati, Bangalore (IN); Philippe Renaud, Sanchey (FR); Piotr Gawron, Cracow (PL); Bjoern Schenk, Commugny (CH)

(73) Assignee: Garrett Transportation I Inc., Torrance, CA (US)

( * ) Notice: Subject to any disclaimer, the term of this patent is extended or adjusted under 35 U.S.C. 154(b) by 93 days.

(21) Appl. No.: 16/668,900

(22) Filed: Oct. 30, 2019

(65) Prior Publication Data

US 2021/0130940 A1 May 6, 2021

(51) Int. Cl.

| | |
|---|---|
| ***C22C 38/48*** | (2006.01) |
| ***C21D 6/00*** | (2006.01) |
| ***C22C 38/00*** | (2006.01) |
| ***C22C 38/02*** | (2006.01) |
| ***C22C 38/04*** | (2006.01) |
| ***C22C 38/22*** | (2006.01) |
| ***F02B 37/16*** | (2006.01) |

(52) U.S. Cl.

CPC ..... *C22C 38/48* (2013.01); *C21D 6/004* (2013.01); *C22C 38/001* (2013.01); *C22C 38/02* (2013.01); *C22C 38/04* (2013.01); *C22C 38/22* (2013.01); *F02B 37/164* (2013.01); *C21D 2211/001* (2013.01); *F05D 2220/40* (2013.01)

(58) Field of Classification Search

CPC . C21D 2211/001; C21D 6/004; C22C 38/001; C22C 38/02; C22C 38/04; F02B 37/164; F05D 2220/40

USPC ..... 420/46

See application file for complete search history.

(56) References Cited

U.S. PATENT DOCUMENTS

| | | | | |
|---|---|---|---|---|
| 2,256,614 A * | 9/1941 | Franks | C22C 38/58 | 420/586 |
| 2,891,858 A * | 6/1959 | Kegerise | C22C 38/58 | 420/49 |
| 4,929,419 A * | 5/1990 | Wegman | C22C 38/58 | 148/326 |
| 5,019,332 A * | 5/1991 | Wegman | C22C 38/58 | 420/47 |
| 8,663,549 B2 * | 3/2014 | Ohishi | C22C 38/58 | 420/42 |

(Continued)

*Primary Examiner* — Jie Yang

(74) *Attorney, Agent, or Firm* — Quinn IP Law

(57) ABSTRACT

Disclosed is an austenitic stainless steel alloy that includes or consists of, by weight, about 20.0% to about 21.5% chromium, about 8.5% to about 10.0% nickel, about 4.0% to about 5.0% manganese, about 0.5% to about 2.0% silicon, about 0.4% to about 0.5% carbon, about 0.2% to about 0.3% nitrogen, and a balance of iron with inevitable/unavoidable impurities. The elements niobium, tungsten, and molybdenum are excluded beyond impurity levels. Turbocharger turbine housings made of the stainless steel alloy, and methods of making the same, are also disclosed. The stainless steel alloy is suitable for use in turbocharger turbine applications for temperatures up to about 1020° C.

20 Claims, 1 Drawing Sheet

(56) References Cited

U.S. PATENT DOCUMENTS

2008/0240970 A1* 10/2008 Eto ..... C21D 6/004
420/84
2020/0095662 A1* 3/2020 Fukuda ..... F16C 33/145

* cited by examiner

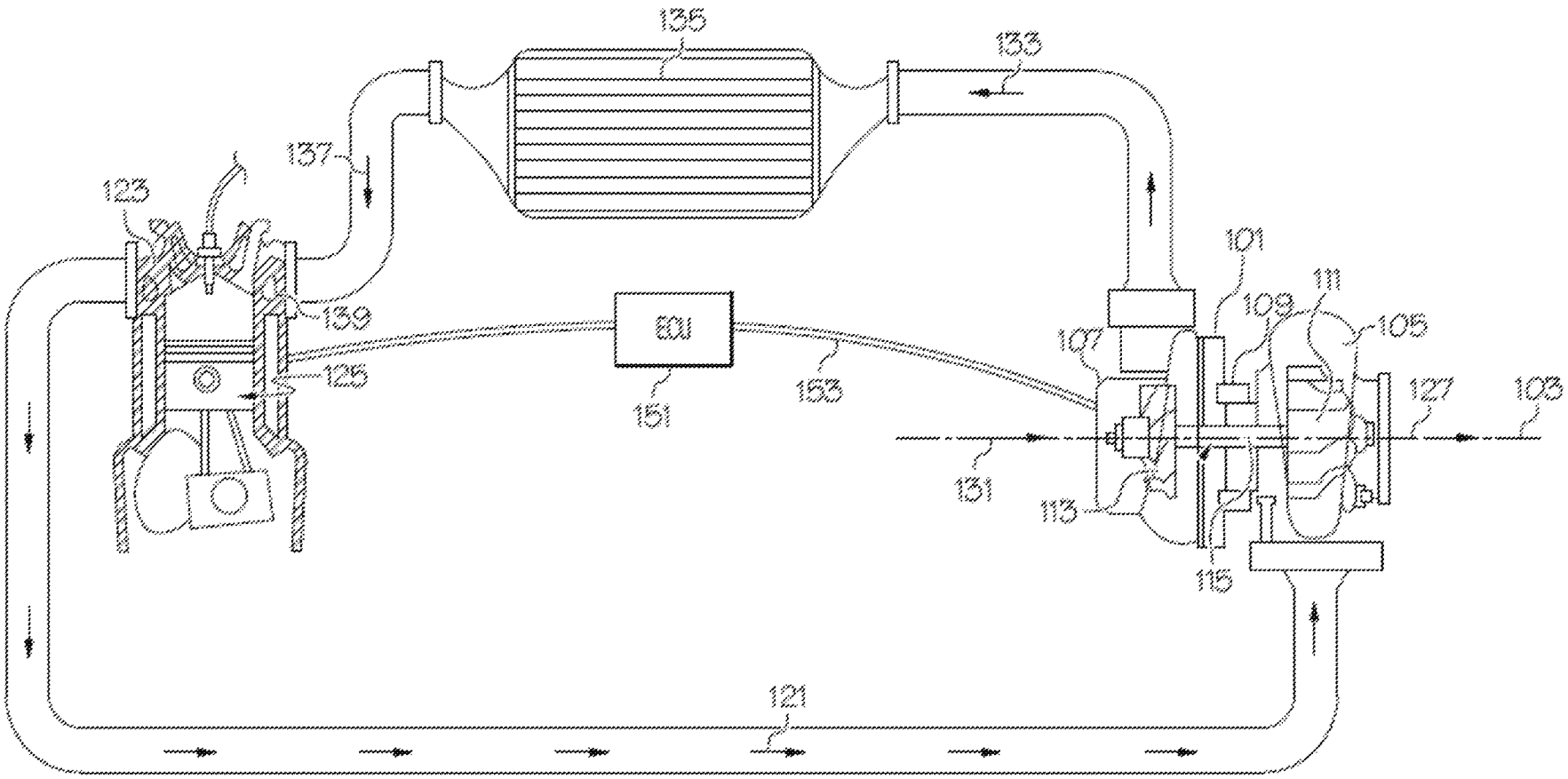
103
127
105
111
109
101
119
107
113
133
131
163
135
ECU
161
121
137
139
125
123

STAINLESS STEEL ALLOYS, TURBOCHARGER COMPONENTS FORMED FROM THE STAINLESS STEEL ALLOYS, AND METHODS FOR MANUFACTURING THE SAME

TECHNICAL FIELD

The present disclosure generally relates to stainless steel alloys. More particularly, the present disclosure relates to stainless steel alloys used for casting applications, for example turbine and turbocharger housings, exhaust manifolds, and combustion chambers, which exhibit oxidation resistance at elevated temperatures, and methods for manufacturing the same.

BACKGROUND

During operation, automotive or aircraft turbocharger components are subjected to elevated operating temperatures. These components must be able to contain a turbine wheel generating very high rotational speeds. Exhaust gas from the automotive or aircraft engine initially contacts the turbocharger in metal sections, such as the gas inlet area of the turbocharger, at elevated temperatures. As high-speed performance improves through exhaust temperature increase, there have been attempts to gradually raise the exhaust temperature of the engine. Due to these high temperatures, the thermal load on the parts such as the exhaust manifold and the turbine housing becomes very great.

Various problems have been encountered by these increased exhaust gas temperatures contacting metal sections of the turbocharger. For example, one problem caused by the exhaust temperature rise is the problem of corrosion or oxidation. At temperatures above about 800° C., for example, and depending on the particular alloy employed, oxygen may begin to attack the metallic elements of the alloy, causing them to oxidize or corrode and thus lose their beneficial physical and material properties. Over repeated cycles of operation, corrosion or oxidation can eventually cause a part to fail entirely.

In order to overcome the challenges associated with higher operating temperatures, prior art alloys used in turbocharger applications have included stainless steel alloys of higher chromium and nickel content, such as commercially available high chromium and/or nickel ductile iron casting alloys. As used herein, the term operating temperature refers to the maximum temperature of exhaust gas (barring the occasional higher transient temperatures) designed to be experienced by the turbine housing and blade components of the turbocharger. These higher chromium and nickel stainless steels are primarily austenitic with a stabile austenite phase that exists well above the operating temperature, as well as minimal to no delta ferrite phase, which promotes corrosion/oxidation. Stainless steel alloys of the 1.48XX series, such as stainless steel 1.4848, are well-known in the art. Having a specification for chromium between 23% and 27% and a specification for nickel between 19% and 22% (all percentages by weight), they are exemplary prior art materials for turbine housing applications between 1000° C.-1020° C. While meeting the high temperature property requirements for turbocharger housings, stainless steel 1.4848 is quite expensive because of its high chromium and nickel content. As the turbocharger housing is generally the most expensive component of the turbocharger, the overall cost of the machine is greatly affected by the choice in material employed for this component.

Alternatively, K273 with lower chromium and nickel content can be used for housing temperatures up to 1020° C. However, due to a higher carbon content, K273 poses manufacturing concerns in terms of machinability. Also, laboratory oxidation tests indicated lower oxidation resistance of K273 in comparison with other stainless steels recommended for such high temperature applications. TABLE 1, set forth below, provides the specifications for stainless steels 1.4848 and K273, in percentages by weight:

TABLE 1

Composition of K273 and 1.4848 Stainless Steels.

| | K273 | | 1.4848 | |
|---|---|---|---|---|
| Elements | Min (%) | Max (%) | Min (%) | Max (%) |
| Carbon | 0.75 | 0.9 | 0.3 | 0.5 |
| Silicon | 0.3 | 1 | 1 | 2.5 |
| Chromium | 18 | 21 | 23 | 27 |
| Nickel | 4.5 | 5.5 | 19 | 22 |
| Molybdenum | 0.8 | 1.2 | 0 | 0.5 |
| Manganese | 4.5 | 5.5 | 0 | 2 |
| Tungsten | 0.8 | 1.2 | — | — |
| Niobium | 0.65 | 0.8 | 0 | 1.6 |
| Phosphorous | 0 | 0.02 | 0 | 0.04 |
| Sulphur | 0 | 0.02 | 0 | 0.04 |
| Nitrogen | 0.2 | 0.4 | — | — |
| Iron | Balance | | Balance | |

Thus, materials that are less expensive, and that have less machining issues and better oxidation resistance, will be a suitable alternative to the available options. These materials should have a stable austenite phase that exists above the operating temperature, as well as minimal to no delta ferrite phase. Accordingly, there is a need for stainless steel alloys useful in turbocharger applications that are able to withstand the higher operating temperatures produced by modern engines, but that minimize the expensive nickel content. Furthermore, other desirable features and characteristics of the inventive subject matter will become apparent from the subsequent detailed description of the inventive subject matter and the appended claims, taken in conjunction with the accompanying drawings and this background of the inventive subject matter.

BRIEF SUMMARY

Stainless steel alloys, turbocharger turbine components, and methods of manufacturing turbocharger turbine components are provided.

In an embodiment, by way of example only, an austenitic stainless steel alloy includes or consists of, by weight, about 20.0% to about 21.5% chromium, about 8.5% to about 10.0% nickel, about 4.0% to about 5.0% manganese, about 0.5% to about 2.0% silicon, about 0.4% to about 0.5% carbon, about 0.2% to about 0.3% nitrogen, and a balance of iron with inevitable/unavoidable impurities. The elements niobium, tungsten, and molybdenum are excluded beyond impurity levels. As a variation to the foregoing embodiment, the alloy may include or consist of chromium in an amount of about 20.3% to about 21.2%, or about 20.5% to about 21.0%. As a variation to any of the foregoing embodiments, the alloy may include or consist of nickel in an amount of about 8.8% to about 9.7%, or about 9.0% to about 9.5%. As a variation to any of the foregoing embodiments, the alloy may include or consist of manganese in an amount of about 4.1% to about 4.9%, or about 4.2% to about 4.8%. As a variation to any of the foregoing embodiments, the alloy may include or consist of silicon in an amount of about 0.6% to about 0.9%. As a variation to any of the foregoing embodiments, the alloy may include or consist of carbon in an amount of about 0.42% to about 0.48%. As a variation to any of the foregoing embodiments, the alloy may include or consists of nitrogen in an amount of about 0.22% to about 0.28%.

In another embodiment, by way of example only, a turbocharger turbine housing includes an austenitic stainless steel alloy that includes or consists of, by weight, about 20.0% to about 21.5% chromium, about 8.5% to about 10.0% nickel, about 4.0% to about 5.0% manganese, about 0.5% to about 2.0% silicon, about 0.4% to about 0.5% carbon, about 0.2% to about 0.3% nitrogen, and a balance of iron with inevitable/unavoidable impurities. The elements niobium, tungsten, and molybdenum are excluded beyond impurity levels. As a variation to the foregoing embodiment, the alloy may include or consist of chromium in an amount of about 20.3% to about 21.2%, or about 20.5% to about 21.0%. As a variation to any of the foregoing embodiments, the alloy may include or consist of nickel in an amount of about 8.8% to about 9.7%, or about 9.0% to about 9.5%. As a variation to any of the foregoing embodiments, the alloy may include or consist of manganese in an amount of about 4.1% to about 4.9%, or about 4.2% to about 4.8%. As a variation to any of the foregoing embodiments, the alloy may include or consist of silicon in an amount of about 0.6% to about 0.9%. As a variation to any of the foregoing embodiments, the alloy may include or consist of carbon in an amount of about 0.42% to about 0.48%. As a variation to any of the foregoing embodiments, the alloy may include or consists of nitrogen in an amount of about 0.22% to about 0.28%.

In yet another embodiment, a method of fabricating a turbocharger turbine housing include forming the turbocharger turbine housing from an austenitic stainless steel alloy that includes or consists of, by weight, about 20.0% to about 21.5% chromium, about 8.5% to about 10.0% nickel, about 4.0% to about 5.0% manganese, about 0.5% to about 2.0% silicon, about 0.4% to about 0.5% carbon, about 0.2% to about 0.3% nitrogen, and a balance of iron with inevitable/unavoidable impurities. The elements niobium, tungsten, and molybdenum are excluded beyond impurity levels. As a variation to the foregoing embodiment, the alloy may include or consist of chromium in an amount of about 20.3% to about 21.2%, or about 20.5% to about 21.0%. As a variation to any of the foregoing embodiments, the alloy may include or consist of nickel in an amount of about 8.8% to about 9.7%, or about 9.0% to about 9.5%. As a variation to any of the foregoing embodiments, the alloy may include or consist of manganese in an amount of about 4.1% to about 4.9%, or about 4.2% to about 4.8%. As a variation to any of the foregoing embodiments, the alloy may include or consist of silicon in an amount of about 0.6% to about 0.9%. As a variation to any of the foregoing embodiments, the alloy may include or consist of carbon in an amount of about 0.42% to about 0.48%. As a variation to any of the foregoing embodiments, the alloy may include or consists of nitrogen in an amount of about 0.22% to about 0.28%.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE DRAWINGS

The inventive subject matter will hereinafter be described in conjunction with the following drawing wherein:

The drawing is a system view of an embodiment of a turbocharger for a turbocharged internal combustion engine in accordance with the present disclosure.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. Furthermore, as used herein, numerical ordinals such as "first," "second," "third," etc., such as first, second, and third components, simply denote different singles of a plurality unless specifically defined by language in the appended claims. Still further, the term "about" is used herein to imply a variance in the stated compositional percentage by +/−10% on a relative basis, or by +/−5% on a relative basis, or by +/−1% on a relative basis. Of course, any compositional percentage used with the term "about" may also be understood to include the exact (or substantially the exact in terms of precision with regard to the decimal place) compositional percentage as stated, in some embodiments.

All of the embodiments and implementations of the stainless steel alloys, turbocharger turbine components, and methods for the manufacture thereof described herein are exemplary embodiments provided to enable persons skilled in the art to make or use the invention and not to limit the scope of the invention, which is defined by the claims. Furthermore, there is no intention to be bound by any expressed or implied theory presented in the preceding technical field, background, brief summary, or the following detailed description.

The present disclosure generally relates to austenitic stainless steel alloys suitable for use in various turbocharger turbine and exhaust applications. Exemplary turbocharger turbine components in accordance with the present disclosure include turbine housing components and turbine exhaust components, which are subject to operating temperatures up to about 1020° C. in some applications. The turbocharger turbine housing, usually a cast stainless steel or cast iron, is often the most expensive component of the turbocharger. Reduction in cost of the housing will have a direct effect on the cost of the turbocharger. In order to withstand the high operating temperatures commonly produced by exhaust gasses impinging on the turbine housing, turbine housing materials are usually alloyed with elements such as chromium and nickel in addition to other carbide forming elements, resulting in increased cost. Reducing the content and/or eliminating these expensive alloying elements will have a direct effect on the cost of the turbine housing.

Typical embodiments of the present disclosure reside in a vehicle, such as a land-, air-, or water-operating vehicle, equipped with a powered internal combustion engine ("ICE") and a turbocharger. The turbocharger is equipped with a unique combination of features that may, in various embodiments, provide efficiency benefits by relatively limiting the amount of (and kinetic energy of) secondary flow in the turbine and/or compressor, as compared to a comparable unimproved system.

With reference to FIG. 1, an exemplary embodiment of a turbocharger 101 having a radial turbine and a radial compressor includes a turbocharger housing and a rotor configured to rotate within the turbocharger housing around an axis of rotor rotation 103 during turbocharger operation on thrust bearings and two sets of journal bearings (one for each respective rotor wheel), or alternatively, other similarly supportive bearings. The turbocharger housing includes a turbine housing 105, a compressor housing 107, and a bearing housing 109 (i.e., a center housing that contains the bearings) that connects the turbine housing to the compressor housing. The rotor includes a radial turbine wheel 111 located substantially within the turbine housing 105, a radial compressor wheel 113 located substantially within the compressor housing 107, and a shaft 115 extending along the axis of rotor rotation 103, through the bearing housing 109, to connect the turbine wheel 111 to the compressor wheel 113.

The turbine housing 105 and turbine wheel 111 form a turbine configured to circumferentially receive a high-pressure and high-temperature exhaust gas stream 121 from an engine, e.g., from an exhaust manifold 123 of an internal combustion engine 125. The turbine wheel 111 (and thus the rotor) is driven in rotation around the axis of rotor rotation 103 by the high-pressure and high-temperature exhaust gas stream, which becomes a lower-pressure and lower-temperature exhaust gas stream 127 and is axially released into an exhaust system (not shown).

The compressor housing 107 and compressor wheel 113 form a compressor stage. The compressor wheel, being driven in rotation by the exhaust-gas driven turbine wheel 111, is configured to compress axially received input air (e.g., ambient air 131, or already-pressurized air from a previous-stage in a multi-stage compressor) into a pressurized air stream 133 that is ejected circumferentially from the compressor. Due to the compression process, the pressurized air stream is characterized by an increased temperature over that of the input air.

Optionally, the pressurized air stream may be channeled through a convectively cooled charge air cooler 135 configured to dissipate heat from the pressurized air stream, increasing its density. The resulting cooled and pressurized output air stream 137 is channeled into an intake manifold 139 on the internal combustion engine, or alternatively, into a subsequent-stage, in-series compressor. The operation of the system is controlled by an ECU 151 (engine control unit) that connects to the remainder of the system via communication connections 153.

Embodiments of the present disclosure are directed to improvements over the currently available stainless steel alloys for use in turbochargers having operating temperatures up to about 1020° C. In particular, embodiments of the present disclosure are directed to austenitic stainless steel alloys that have a chromium content and a nickel content that is less than stainless steel 1.4848 for cost considerations, and better machinability than K273 for manufacturing considerations. The stainless steel alloys described herein include iron alloyed with various alloying elements, as are described in greater detail below in weight percentages based on the total weight of the alloy. Moreover, the discussion of the effects and inclusion of certain percentages of elements is particular to the inventive alloy described herein.

In an embodiment, the austenitic stainless steel alloy of the present disclosure includes or consists of from about 20.0% to about 21.5% chromium (Cr), for example about 20.3% to about 21.2% Cr, such as about 20.5% to about 21.0% Cr. Chromium is provided, for example, to achieve the desired austenite phase for oxidation/corrosion resistance in the alloy when operating at relatively high temperatures, such as up to about 1020° C. As stated initially, however, it is desirable to minimize the Cr content in order to reduce costs. Moreover, when the content of Cr increases, the content of similarly expensive Ni should be also increased to maintain the volume fraction, resulting in further cost increases. Furthermore, if Cr is added excessively, coarse primary carbides of Cr are formed, resulting in extreme brittleness. As such, it has been found herein that a balance is achieved between sufficient austenite phase stability and prevention of delta ferrite phase formation (along with cost reduction) when Cr is provided within the above described ranges, for example from about 20.0% to about 21.5%.

In an embodiment, the austenitic stainless steel alloy of the present disclosure includes or consists of from about 8.5% to about 10.0% nickel (Ni), for example about 8.8% to about 9.7% Ni, such as about 9.0% to about 9.5% Ni. Ni, together with manganese and nitrogen (which as described in greater detail below are included in the alloy of the present disclosure), is an element to stabilize the austenite phase, which as noted above is desirable to achieve the oxidation/corrosion resistance at high temperatures, along with the aforementioned Cr. To reduce production costs, if the content of relatively-expensive Ni is lowered, the decrement of Ni can be replaced by increasing the content of manganese and nitrogen that form the austenite phase. However, it has been found that if the content of Ni is excessively lowered, manganese and nitrogen would be excessively needed such that the corrosion/oxidation resistance and the hot formability characteristics are deteriorated. As such, it has been found herein that a balance is achieved between sufficient austenite phase stability and casting considerations (along with cost reduction) when Ni is provided within the above described ranges, for example from about 8.5% to about 10.0%.

In an embodiment, the austenitic stainless steel alloy of the present disclosure includes or consists of from about 4.0% to about 5.0% manganese (Mn), for example about 4.1% to about 4.9% Mn, such as about 4.2% to about 4.8% Mn. As initially noted above, Mn is provided for the stability of the austenite phase. Moreover, Mn is effective along with Si (which as described in greater detail below is included in the alloy of the present disclosure) as a deoxidizer for the melt, and it has a benefit of improving the fluidity during the casting operation. However, when the content of Mn is excessive, Mn is combined with sulfur of the steel and forms excessive levels of manganese sulfide, thereby deteriorating the corrosion resistance and the hot formability. As such, it has been found herein that a balance is achieved between sufficient austenite phase stability, deoxidation properties, and casting considerations when Mn is provided within the above described ranges, for example from about 4.0% to about 5.0%.

In an embodiment, the austenitic stainless steel alloy of the present disclosure includes or consists of from about 0.5% to about 2.0% silicon (Si), for example about 0.6% to about 0.9% Si. Si has effects of increasing the stability of its metal structure and its oxidation resistance. Further, it has a function as a deoxidizer and also is effective for improving castability and reducing pin holes in the resulting cast products. If the content of Si is excessive, Si deteriorates mechanical properties of the alloy such as impact toughness of steel. As such, it has been found herein that a balance is achieved between sufficient mechanical properties, deoxidation properties, and casting considerations when Si is provided within the above described ranges, for example from about 0.5% to about 2.0%.

In an embodiment, the austenitic stainless steel alloy of the present disclosure includes or consists of from about 0.4% to about 0.5% carbon (C), for example about 0.42% to about 0.48% C. C generally provides hardness and strength to stainless steel and can form carbides with the metallic elements. Furthermore, C has a function of improving the fluidity and castability of a melt. When provided excessively, however, C can make stainless steel brittle, rendering it more likely to crack during use in turbocharger applications. As such, it has been found herein that a balance is achieved between sufficient mechanical properties and casting considerations when C is provided within the above described ranges, for example about 0.4% to about 0.5%.

In an embodiment, the austenitic stainless steel alloy of the present disclosure includes or consists of from about 0.2% to about 0.3% nitrogen (N), for example from about 0.22% to about 0.28% N. N, together with Ni, is one of elements that contribute stabilization of an austenite phase. As the content of N increases, the corrosion/oxidation resistance and high strengthening are achieved. However, when the content of N is too high, the hot formability of steel is deteriorated, thereby lowering the production yield thereof. Moreover, N is an element capable of improving the high-temperature strength and the thermal fatigue resistance like C. However, when N content is excessive, brittleness due to the precipitation of Cr nitrides may be encountered. As such, it has been found herein that a balance is achieved between austenite phase stability and corrosion/oxidation resistance, sufficient mechanical properties, and casting considerations when N is provided within the above described ranges, for example about 0.2% to about 0.3%.

Certain unavoidable/inevitable impurities may also be present in the austenitic stainless steel alloy of the present disclosure. The amounts of such impurities are minimized as much as practical. In an embodiment, phosphorus (P) may be present in the alloy, but is minimized to about 0.03% or less, and is preferably minimized to about 0.02% or less. P is seeded in the grain boundary or an interface, and it is likely to deteriorate the corrosion resistance and toughness. Therefore, the content of P is lowered as much as possible. Additionally, sulfur (S) may be present in the alloy, but is minimized to about 0.03% or less, and is preferably minimized to about 0.02% or less. S in steels deteriorates hot workability and can form sulfide inclusions (such as MnS) that influence pitting corrosion resistance negatively. Therefore, the content of S is lowered as much as possible.

In an embodiment, certain relatively-expensive carbide forming elements may be excluded beyond impurity levels. These include, for example, niobium, tungsten, and molybdenum, and any combination of two or more thereof may be excluded. It has been discovered that austenite phase stability, delta ferrite phase minimization, and sufficient mechanical and casting properties can be achieved without including these elements beyond levels that cannot be avoided as impurities, such as less than about 0.3%, less than about 0.1%, or less than about 0.05%. Further specific elements that may be excluded from the alloy (in greater than impurity amounts) include one or more of aluminum, titanium, vanadium, cobalt, and/or copper, and any combination of two or more thereof may be excluded beyond levels that cannot be avoided as impurities, such as less than about 0.3%, less than about 0.1%, or less than about 0.05%, which percentage is dependent on the particular element under consideration.

Iron makes up the balance of the alloy as described herein. The disclosed alloy may comprise the foregoing elements, in that other elements may be included in the alloy composition within the scope of the present disclosure. Preferably, however, the disclosed alloy consists of the foregoing elements, in that other elements beyond those described above are not included in the alloy (in greater than inevitable/unavoidable impurity amounts).

TABLE 2 sets forth the compositional ranges of an exemplary austenitic stainless steel alloy the present disclosure, in accordance with an embodiment of the description provided above (all elements in wt.-%).

TABLE 2

Composition of the Inventive Stainless Steel Alloy.

| Elements | Min (wt.-%) | Max (wt.-%) |
|---|---|---|
| Chromium | 20.0 | 21.5 |
| Nickel | 8.5 | 10.0 |
| Manganese | 4.0 | 5.0 |
| Silicon | 0.5 | 2.0 |
| Carbon | 0.4 | 0.5 |
| Nitrogen | 0.2 | 0.3 |
| Sulphur | 0 | 0.03 |
| Phosphorous | 0 | 0.03 |
| Iron/Impurities | Balance | |

ILLUSTRATIVE EXAMPLES

The present disclosure is now illustrated by the following non-limiting examples. It should be noted that various changes and modifications, can be applied to the following examples and processes, without departing from the scope of this disclosure, which is defined in the appended claims. Therefore, it should be noted that the following examples should be interpreted as illustrative only and not limiting in any sense.

Using the materials simulation software Thermo-Calc® (available from Thermo-Calc Software AB; Stockholm, Sweden), various alloy compositions within the elemental ranges described above were tested for austenite phase content and delta ferrite phase content. As noted above, it is desirable for the austenite phase to be stable at-and-above the intended design operating temperature of 1020° C., whereas the delta ferrite phase should be substantially note present, or at least minimized as much as practical, in order for the stainless steel to be able to avoid corrosion/oxidation.

In a first example, a simulated phase diagram of an alloy in accordance with the present disclosure (20% Cr, 8.5% Ni, 4.5% Mn, 0.5% Si, 0.2% N, variable C from 0.0% to 1.0%, balance Fe) was prepared to demonstrate the phase constituencies (particularly austenite and delta ferrite) of the alloy over various temperatures ranging from about 400° C. to about 1600° C. as a function of carbon content. It was demonstrated that the austenite phase remains stable well above 1020° C., whereas the delta ferrite phase substantially is not present above 0.4% C. Thus, the lower limit of 0.4% C is established as suitable for the embodiments of the present disclosure.

In further examples, simulated phase diagrams of various alloys in accordance with the present disclosure were prepared to demonstrate the phase constituencies (particularly austenite and delta ferrite) of the alloys over various temperatures as a function of nitrogen content. Each of the various alloys were prepared as follows: Mn content is 4.5%. Furthermore, for a first series of alloys, Cr content is 20.0% and Ni content is 8.5%; for a second series of alloys, Cr content is 21.5% and Ni content is 8.5%; for a third series of alloys, Cr content is 20.0% and Ni content is 10.0%; and, for a fourth series of alloys, Cr content is 21.5% and Ni content is 10.0%. With regard to one alloy of each series the C content is 0.4% and the Si content is 0.5%; with regard to another alloy of each series, the C content is 0.4% and the Si content is 1.0%; with regard to yet another alloy of each series, the C content is 0.5% and the Si content is 0.5%; and, with regard to a still further alloy of each series, the C content is 0.5% and the Si content is 1.0%. For each of the foregoing alloys, the material phase content was demonstrated as a function of N content over various temperatures ranging from about 400° C. to about 1600° C. Thus, the full range of each of Cr, Ni, Si, C, and N, in accordance with embodiments of the present disclosure, are tested in various combinations, for purposes of determining the phase content, particularly with regard to the austenite phase and the delta ferrite phase. As demonstrated, for each of the various combinations, the austenite phase remains stable well above 1020° C., whereas the delta ferrite phase substantially is not present above 0.2% N. Thus, the lower limit of 0.2% N is established as suitable for the embodiments of the present disclosure, and further the ranges of Cr, Ni, Si, C, and N are established as suitable for the embodiments of the present disclosure.

As such, embodiments of the present disclosure provide numerous benefits over the prior art, including the minimization of expensive nickel content, while maintaining desirable material properties for use as turbocharger turbine components, such as housing components or exhaust components. Moreover, the disclosed alloys maintain a stable austenite material phase above the intended temperature of operation, such as 1020° C., while substantially minimizing the corrosion/oxidation-prone delta ferrite material phase. Thus, embodiments of the present disclosure are suitable for use as a lower cost alloy for turbocharger turbine components, such as turbocharger turbine housing, for design operations of up to about 1020° C.

While at least one exemplary embodiment has been presented in the foregoing detailed description of the inventive subject matter, it should be appreciated that a vast number of variations exist. It should also be appreciated that the exemplary embodiment or exemplary embodiments are only examples, and are not intended to limit the scope, applicability, or configuration of the inventive subject matter in any way. Rather, the foregoing detailed description will provide those skilled in the art with a convenient road map for implementing an exemplary embodiment of the inventive subject matter. It being understood that various changes may be made in the function and arrangement of elements described in an exemplary embodiment without departing from the scope of the inventive subject matter as set forth in the appended claims.

What is claimed is:

1. An austenitic stainless steel alloy, comprising, by weight:
20.0% to 21.5% chromium;
8.5% to 10.0% nickel;
4.6% to 4.9% manganese;
0.5% to 1.0% silicon;
0.4% to 0.5% carbon;
0.2% to 0.3% nitrogen;
less than 0.03% phosphorous; and
a balance of iron with inevitable/unavoidable impurities,
wherein niobium, molybdenum, vanadium, copper, and tungsten are excluded from the alloy beyond impurity levels, and wherein an oxide containing boron is excluded from the alloy.

2. The austenitic stainless steel alloy of claim 1 comprising 20.3% to 21.2% chromium.

3. The austenitic stainless steel alloy of claim 1 comprising 8.8% to 9.7% nickel.

4. The austenitic stainless steel alloy of claim 1 comprising 0.6% to 0.9% silicon.

5. The austenitic stainless steel alloy of claim 1 comprising 0.42% to 0.48% carbon.

6. The austenitic stainless steel alloy of claim 1 comprising 0.22% to 0.28% nitrogen.

7. The austenitic stainless steel alloy of claim 1, consisting of, by weight:
20.0% to 21.5% chromium;
8.5% to 10.0% nickel;
4.6% to 4.9% manganese;
0.5% to 1.0% silicon;
0.4% to 0.5% carbon;
0.2% to 0.3% nitrogen;
less than 0.03% phosphorous; and
a balance of iron with inevitable/unavoidable impurities.

8. The austenitic stainless steel alloy of claim 1, wherein vanadium is excluded from the alloy beyond impurity levels in an amount of less than 0.1% by weight.

9. The austenitic stainless steel alloy of claim 1, wherein vanadium is excluded from the alloy beyond impurity levels in an amount of less than 0.05% by weight.

10. The austenitic stainless steel alloy of claim 1, wherein molybdenum, vanadium, and tungsten are excluded from the alloy beyond impurity levels in a combined amount of less than 0.1% by weight.

11. A turbocharger turbine component comprising:
an austenitic stainless steel alloy, wherein the austenitic stainless steel alloy comprises, by weight:
20.0% to 21.5% chromium;
8.5% to 10.0% nickel;
4.6% to 4.9% manganese;
0.5% to 1.0% silicon;
0.4% to 0.5% carbon;
0.2% to 0.3% nitrogen;
less than 0.03% phosphorous; and
a balance of iron with inevitable/unavoidable impurities,
niobium, molybdenum, vanadium, copper, and tungsten are excluded from the alloy beyond impurity levels, and wherein an oxide containing boron is excluded from the alloy.

12. The turbocharger turbine component of claim 11, wherein the austenitic stainless steel comprises 20.3% to 21.2% chromium.

13. The turbocharger turbine component of claim 11, wherein the austenitic stainless steel alloy comprises 8.8% to 9.7% nickel.

14. The turbocharger turbine component of claim 11, wherein the austenitic stainless steel alloy comprises 0.6% to 0.9% silicon.

15. The turbocharger turbine component of claim 11, wherein the austenitic stainless steel alloy comprises 0.42% to 0.48% carbon.

16. The turbocharger turbine component of claim 11, wherein the austenitic stainless steel alloy comprises 0.22% to 0.28% nitrogen.

17. The turbocharger turbine component of claim 11, wherein the austenitic stainless steel alloy consists of, by weight:
20.0% to 21.5% chromium;
8.5% to 10.0% nickel;
4.6% to 4.9% manganese;
0.5% to 1.0% silicon;
0.4% to 0.5% carbon;
0.2% to 0.3% nitrogen;

less than 0.03% phosphorous; and a balance of iron with inevitable/unavoidable impurities.

18. The turbocharger turbine component of claim 11, wherein the turbocharger turbine component comprises a turbocharger turbine housing.

19. A vehicle comprising the turbocharger turbine component of claim 11.

20. A method of making a turbocharger turbine component comprising forming the turbocharger turbine component using an austenitic stainless steel alloy, wherein the austenitic stainless steel alloy comprises, by weight:

20.0% to 21.5% chromium;

8.5% to 10.0% nickel;

4.6% to 4.9% manganese;

0.5% to 1.0% silicon;

0.4% to 0.5% carbon;

0.2% to 0.3% nitrogen;

less than 0.03% phosphorous; and a balance of iron with inevitable/unavoidable impurities, niobium, molybdenum, vanadium, copper, and tungsten are excluded from the alloy beyond impurity levels, and wherein an oxide containing boron is excluded from the alloy.

* * * * *